United States Patent [19]

O'Brien

[11] Patent Number: 4,919,313

[45] Date of Patent: Apr. 24, 1990

[54] CARTON POURING DEVICE

[75] Inventor: Patrick J. O'Brien, Hackensack, N.J.

[73] Assignee: Container Corporation of America, Clayton, Mo.

[21] Appl. No.: 281,272

[22] Filed: Dec. 8, 1988

[51] Int. Cl.[5] ..... B65D 47/10

[52] U.S. Cl. ..... 222/541; 222/556; 222/569; 215/253; 229/102; 229/125.08

[58] Field of Search ..... 222/541, 544, 545, 556, 222/569; 215/201, 232, 251, 253, 256; 220/334, 337, 339, 265, 266; 229/102, 125.08, 125.11, 125.12, 155, 160.2

[56] References Cited

U.S. PATENT DOCUMENTS

| | | | |
|---|---|---|---|
| 2,313,278 | 3/1943 | Straub | 222/541 |
| 3,160,327 | 12/1964 | Porcelli | 222/541 |
| 3,568,910 | 3/1971 | McConnell | 229/125.42 |
| 4,059,201 | 11/1977 | Foster | 220/339 |
| 4,284,200 | 8/1981 | Bush et al. | 222/545 |
| 4,669,640 | 6/1987 | Ando et al. | 222/541 |
| 4,795,065 | 1/1989 | Ashizawa et al. | 222/556 |
| 4,801,037 | 1/1989 | Hayashida et al. | 229/125.08 |

*Primary Examiner*—Kevin P. Shaver
*Assistant Examiner*—Steven Reiss
*Attorney, Agent, or Firm*—Richard W. Carpenter

[57] ABSTRACT

A one-piece, molded plastic, reclosable, pouring device adapted to be secured to an outer wall of a paperboard carton, adjacent an opening in said carton wall, to provide a tamper evident dispensing package for particulate type materials. The device includes a base member adapted to be located in the carton and secured to the carton wall adjacent the opening, and a cover member adapted to be located outside the carton and hingedly connected to the base member for snug engagement with the base member to provide a relatively tight fit therebetween upon reclosure of the package.

2 Claims, 1 Drawing Sheet

CARTON POURING DEVICE

BACKGROUND OF THE INVENTION

1. Field of the Invention

This invention relates to dispensing packages, and more particularly to a dispensing package comprising a paperboard carton with an improved, unitary, molded plastic pouring device secured thereto.

2. Description of the Prior Art

A background search directed to the subject matter of this application and conducted in the U.S. Patent and Trademark Office disclosed the following U.S. Pat. Nos.

| | | | |
|---|---|---|---|
| 3,160,327 | 3,187,964 | 3,239,112 | 3,250,436 |
| 4,284,200 | 2,359,169 | 4,580,687 | 4,724,977 |

None of the patents uncovered in the search discloses a paperboard dispensing carton having a molded plastic pouring device secured to one wall of the carton and comprising a base member presenting an opening outlined by raised flange, and a hinged cover member having a central domed portion adapted to fit snugly over the flange of the base member to provide a relatively tight closure.

SUMMARY OF THE INVENTION

It is an object of the present invention to provide an improved dispensing package for particulate material such as granular, crystal, and powder products, as well as cereal and pasta type products.

A more specific object of the invention is to provide a dispensing package that includes a paperboard carton and a plastic pouring device secured to the carton and comprising a pair of base and cover members having interlocking engagment with each other.

Another specific object of the invention is the provision of a one piece, thermoformed, plastic pouring device that includes a stationary base member adapted to be secured to the inside of a folding carton, and an integral moveable spout member hingedly attached to the base member and having a snap lock type reclosure feature to afford a positive connection between the base and spout members upon reclosure of the package.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 1:
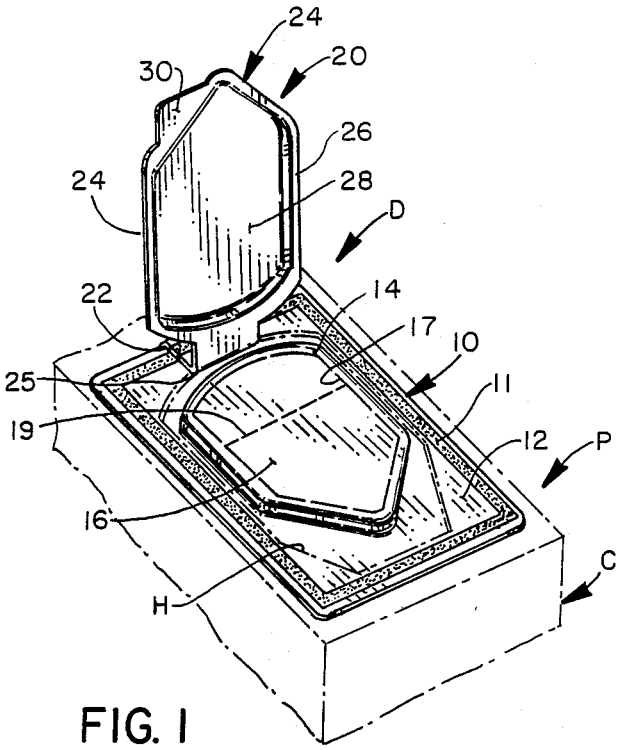
FIG. 1 is a fragmentary perspective view of a dispensing package that includes a pouring device embodying features of the present invention.

Referring now to the drawings for a better understanding of the invention, it will be seen that the dispening package indicated generally at P, and illustrated in FIG. 1 of the drawings, includes a paperboard carton C having an outer wall W with an opening or hole H extending therethrough. The package also includes a novel, one-piece, molded plastic pouring device, indicated generally at D, which is secured to the carton in a manner hereinafter described.

Figure 2:
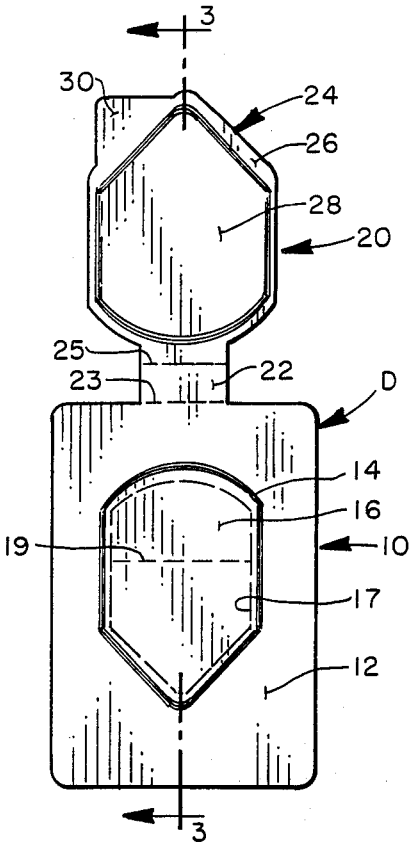
FIG. 2 is a plan view of the pouring device illustrated in FIG. 1, as shown before its attachment to the wall of the carton.
Figure 3:
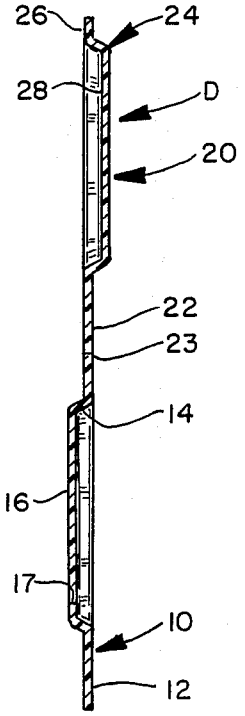
FIG. 3 is a side elevational view of the structure illustrated in FIG. 2.

As best seen in FIG. 2, the novel dispensing device D is a unitary molded plastic article which is preferably molded by thermoforming. The device includes a base member, indicated generally at 10, and a related cover member indicated generally at 20, which is hingedly attached to the base member in a manner hereinafter described.

Base member 10 includes a preferably generally rectangular, thin flat plate 12 which is secured to the underside or inner surface of the carton wall W by an adhesive 11, preferably a hot melt adhesive, that is applied at the periphery of the plate 12.

Plate 12 includes a central pouring opening 13 around which extends a raised flange 14 that flares upwardly and inboardly from the periphery of opening 13.

Figure 5:
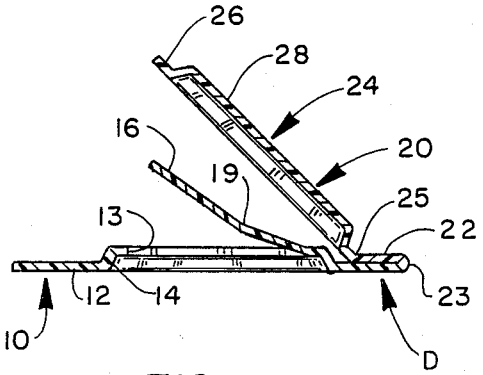
FIG. 5 is a side elevational view of the pouring device illustrated in FIG. 4, but shown in an open position.

As best seen in FIGS. 2 and 5, base member 10 includes a relatively thin flat membrane or seal 16 which is disposed within the pouring opening 13 and detachably secured to the inner edge of flange 14 along a weakened line of tear or series of nicks 17.

The membrane 16 is devided into a pair of sections by a fold line 19 which extends transversely across the membrane. The purpose of the fold line is to facilitate removal of the membrane in a manner hereinafter described.

As previously mentioned, the dispensing device D also includes an integral cover member 20 having a relatively thin flat connecting element 22 disposed to overlie the rear portion of base member plate 12 and which is connected, at its rear edge, along fold line 23 to the rear edge of plate member 12.

The cover member also has a domed cap element 24 which is hingedly connected at its rear edge along a hinge line 25 to the forward edge of connecting element 22.

Figure 4:
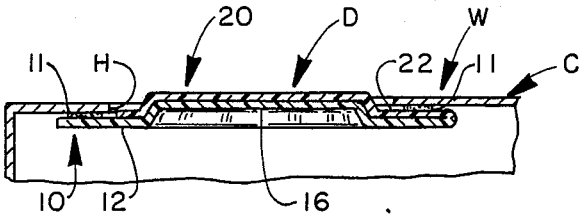
FIG. 4 is a fragmentary, vertical, cross-sectional view of the structure illustrated in FIG. 1, but with the pouring device shown in a closed position.

The cap element includes a relatively thin flat peripheral plate or rim portion 26 which is an extension of connecting element 22. The cap element also has a raised center portion or dome 28 which, as best seen in FIG. 4, is contoured and adapted to fit snugly over the top of base member frame or flange 14 to provide a tight reclosure of the package after its initial opening.

As best seen in FIG. 2, a lift tab 20 may be formed integrally with the rim portion 26 of the cover member to facilitate grasping and lifting of the cover member.

As previously mentioned, in order to attach the pouring device to the carton the cover member 20 is folded along hinge line to overlie base member 10. After this has been done, a peripheral pattern of adhesive 11 is applied to the upper surface of base member plate 12 and a portion of the cover member rim portion 26 adjacent fold line 23.

The entire device is then applied against the inner surface of the carton wall W, with the major portion of the cover member 20 of the pouring device projecting outwardly through the hole H in the carton wall.

In order to dispense material from the package, the lift tab 30 of the cover member is grasped and the cover member is pulled to the open position illustrated in FIG. 1.

At this point, one section of the membrane 16 is pushed into the carton. The fold line 19 permits one section to be pushed in to form an opening into which a finger can be inserted under the remaining portion of the membrane to remove it from the package.

After the material has been dispensed from the carton, the cover member is pushed back down over the base member, as illustrated in FIG. 4, to provide a tight closure for the package.

Thus, it will be appreciated that the novel pouring device provides for the consumer a desirable easy opening, reclosable, pouring arrangement that may be used for all types of particulate materials, and which is relatively simple in design and inexpensive to manufacture.

What is claimed is:

1. A tamper evident dispensing package, for particulate type materials, including a paperboard carton, having an outer carton wall with an opening extending therethrough, and a unitary, molded plastic, reclosable, pouring device secured to said carton at said opening, said device comprising:

(a) a base member including:

(i) a relatively thin plate positioned entirely within the carton and having an outer surface adhesively screwed to an inner surface of said carton wall and having extending therethrough a dispensing opening aligned with the opening in said carton wall;

(ii) an integral closure flange projecting from said plate adjacent the periphery of said dispensing opening and extending out of said carton wall opening;

(iii) an integral sealing membrane detachably secured to to said flange within said dispensing opening and including a pair of sections hingedly connected to each other to facilitate removal of said membrane from said base member upon initial opening of said package;

(b) said cover member including:

(i) a relatively thin flat rim portion hingedly connected to said base member plate and being disposed to overlie said plate;

(ii) an integral center portion extending outwardly from said rim portion and forming a dome-like structure operable to engage said base member sealing flange and provide a relatively tight fit therebetween upon reclosure of the package.

2. A unitary, molded plastic, reclosable, pouring device adapted to be secured to an outer wall of a paperboard carton, adjacent an opening in said carton wall, to provide a tamper evident dispensing package for particulate type materials, said device comprising:

(a) a base member including:

(i) a relatively thin plate adapted to be positioned entirely within a carton and having an outer surface adhesively secured to an inner surface of said carton wall and having extending therethrough a dispensing opening that is alignable with an opening in said carton wall;

(ii) an integral closure flange projecting from said plate adjacent the periphery of said dispensing opening and adapted to extend out of said carton wall opening;

(iii) an integral sealing membrane detachably secured to to said flange within said dispensing opening and including a pair of sections hingedly connected to each other to facilitate removal of said membrane from said base member upon initial opening of said package;

(b) said cover member including:

(i) a relatively thin flat rim portion hingedly connected to said base member plate and adapted to overlie said plate;

(ii) an integral center portion extending outwardly from said rim portion and forming a dome-like structure operable to engage said base member sealing flange and provide a relatively tight fit therebetween upon reclosure.

* * * * *